United States Patent [19]

Seeboeck et al.

[11] Patent Number: 4,939,416

[45] Date of Patent: Jul. 3, 1990

[54] GAS DISCHARGE SWITCH

[75] Inventors: Robert Seeboeck, Bubenreuth; David-Walter Branston, Igelsdorf, both of Fed. Rep. of Germany

[73] Assignees: Siemens Aktiengesellschaft, Berlin; Siemens Aktiengesellschaft, Munich, both of Fed. Rep. of Germany

[21] Appl. No.: 335,281

[22] Filed: Apr. 10, 1989

[30] Foreign Application Priority Data

Apr. 11, 1988 [DE] Fed. Rep. of Germany ..... 3812018

[51] Int. Cl.[5] ..... H01J 19/42; H01J 19/68

[52] U.S. Cl. ..... 313/590; 313/603; 313/613; 313/620; 313/631; 313/231.01; 313/231.31; 313/326; 313/609; 313/231.41

[58] Field of Search ..... 313/590, 603, 609, 613, 313/620, 631, 231.01, 231.31, 362.1, 360.1, 231.41, 622, 621

[56] References Cited

U.S. PATENT DOCUMENTS

| | | | |
|---|---|---|---|
| 3,757,153 | 9/1973 | James | 313/622 X |
| 4,019,079 | 4/1977 | Hardin | 313/603 X |
| 4,335,465 | 6/1982 | Christiansen et al. | 376/156 |

OTHER PUBLICATIONS

Proc. IEE, vol. 111, No. 1, Jan. 1964, pp. 203–213 Low-pressure gas discharge switches for use in fusion experiments;

Sci. Instr. 19 (1986), The Institute of Physics, Great Britain, pp. 466–470, High repetition rate, fast current rise, pseudo-spark switch.

*Primary Examiner*—Kenneth Wieder

*Attorney, Agent, or Firm*—Kenyon & Kenyon

[57] ABSTRACT

A gas discharge switch that has at least two coaxial electrodes which are provided with coaxial holes and form in a central discharge region, a gas discharge path, and an insulating region at their edges. The spacing D in an axial direction of the electrodes is larger than the spacing $d_1$ of the electrodes at the inner edge of a washer-like insulator in the insulating region. The electrodes are respectively connected to one of the flat sides of the insulator, and the spacing $d_1$ is at least as large as the spacing $d_2$ of the electrodes in a shielding region that is formed between the insulating region and the discharge region. A shield that shields the insulator from the discharge region is provided.

18 Claims, 3 Drawing Sheets

GAS DISCHARGE SWITCH

FIELD OF THE INVENTION

The present invention relates to a gas discharge switch, and more particularly to a switch that has at least two coaxial electrodes equipped with coaxial holes to form a gas discharge path in a central discharge zone. At their rims, the coaxial electrodes have an insulating zone. The firing of the gas discharge is achieved by injection of charge carriers in a cathode backspace.

BACKGROUND OF THE INVENTION

The firing voltage for a given gas discharge path and its customary graphic representation is a function of the gas pressure p and the electrode spacing D, and are an important means for characterizing electrical discharge apparatus, when the firing probability is taken into consideration. In determining the dielectric strength of a given gas discharge path, an infinite plate capacitor and its firing characteristic are generally utilized for comparison. The practical embodiment of such discharge paths, however, has electrodes with finite dimensions.

It is sufficient for determining the right-hand branch of the firing characteristic (the Paschen curve) i.e., for investigating the so-called far breakdown region including the voltage minimum, to merely arrange two plane plates parallel to each other, these plates being optionally provided at the edges with a so-called Rogowski profile. However, such an arrangement is not usable for investigating firing characteristics in the left-hand part of the Paschen curve, i.e., in the so-called near breakdown zone, because detour discharges can occur. Such detour discharges can be avoided by an electrode design with plane plate electrodes that are arranged coaxially with each other. These plane plate electrodes are bent off from each other with a radius of curvature that is small relative to the electrode spacing and are brought along the inner cylindrical insulator surface of a hollow cylindrical insulator. Therefore, a gap is always formed between the bent-off cylindrical edge zone of the electrodes and the inside wall of the hollow cylindrical insulator.

As is well known, low-pressure gas discharge paths are suitable as switches for large currents of up to about 2 MA and high voltages of up to about 100 kV. These gas discharge switches operate with a pressure of the working gas, preferably hydrogen, of less than 1 Torr with an electrode spacing of less than 1 cm and a voltage above 10 kV at the left-hand branch of the Paschen curve. Since these switches can only switch on a current but cannot switch it off again they are particularly well suited for discharging large capacitors. The gas discharge switch contains an anode and a cathode which are arranged coaxially relative to each other and form a central discharge zone, an adjacent shielding zone and an insulation zone at their edges. The shielding zone is a coaxially arranged ring-cylindrical canal. The electrodes are radially bent off in the insulation zone and are each connected to one of the flat sides of a washer-shaped insulator. In the insulation zone, at the inner edge of the insulator, the spacing of the electrodes in their axial direction is approximately as large as at the discharge path. In this known arrangement, there is the danger of a breakdown at the insulator (proc. IEE, Vol. III, No. 1, January 1964, pages 203 to 213).

Gas discharge switches with coaxial bore holes in the electrodes, so-called pseudo spark switches, can be controlled by a pulsed low-pressure gas discharge. The main discharge is initiated by a hollow-cathode discharge and is fired by injection of charge carriers. For this purpose, a control apparatus is provided which contains a cage which is provided with holes and surrounds the cathode backspace. The discharge path is separated by the cage from the zone of a preionization discharge, i.e., a glow discharge. Between the cage and the zone of the glow discharge, various auxiliary electrodes for shielding and potential control can further be provided. Such a switch is described in Sci. Instr. 19 (1986), The Inst. of Physics, Great Britain, pages 466 to 470.

In a known gas discharge switch (U.S. Pat. No. 4,335,465) for accelerating electrons and ions, a larger number of electrodes that are provided with coaxial bore holes are arranged coaxially to each other at a relatively small spacing. The electrodes at the ends of the stack and optionally a part of the inner electrodes also are connected to a d-c voltage. In this known arrangement, however, the insulator is in "direct view" of the discharge path, so that vapor deposition on the inside surface of the insulator and irradiation by photons from the discharge zone are possible There is a need to provide an improved gas discharge switch with electrodes that are arranged parallel to each other and are provided with coaxial holes

SUMMARY OF THE INVENTION

An improved gas discharge switch is provided according to the present invention and has at least two coaxial electrodes having coaxial holes. The space between the coaxial electrodes comprises a central discharge region for a gas discharge path, an insulating region at the edges of the coaxial electrodes, and a shielding region between the discharge region and the insulating region. A control device is coupled to the coaxial electrodes and has a cathode backspace. The control device fires a gas discharge by injecting charge carriers in the cathode backspace. A washer-shaped insulator having flat sides and an inner edge is coupled on each side with one of the coaxial electrodes in the insulating region. A means for shielding the insulator is arranged in the shielding region. The spacing D of the coaxial electrodes in the discharge region is larger than the spacing $d_1$ of the coaxial electrodes in the insulating region at the inner edge of the insulator. The spacing $d_1$ in the insulating region is at least as large as the spacing $d_2$ of the coaxial electrode in the shielding region.

In the above embodiment of the gas discharge switch, in which the electrode spacing in the discharge region is larger than in the insulating region and in the shielding region, localization of the discharge in the discharge zone, particularly at the discharge path, is obtained. Since a direct-view connection with the insulator is avoided, vapor deposition on the insulator is prevented.

DETAILED DESCRIPTION

Figure 1:
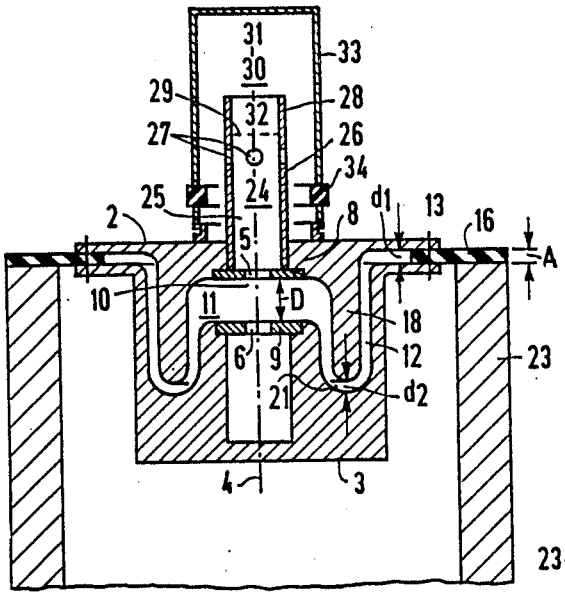
FIG. 1 shows a cross section of an embodiment of a gas discharge switch according to the present invention.

An embodiment of a gas discharge switch constructed according to the present invention is shown in FIG. 1. The switch has two electrodes 2 and 3, of which the electrode 2 is coupled as the cathode and the electrode 3 as the anode in FIG. 1. Each of the electrodes 2 and 3 form a body of rotation, and are arranged coaxial with each other. The axis of rotation, indicated as a dashed-dotted line, is designated by reference numeral 4.

The electrodes 2 and 3 are provided with coaxial bore holes 5 and 6, respectively, at which a discharge path 10 is formed. The electrodes 2 and 3 are made of electrically conductive metal, for instance, alloy steel. At the discharge paths, there are inserts 8 and 9 made of a high-melting temperature metal, such as tungsten or molybdenum or their alloys.

Around the discharge path 10 a discharge zone 11 is formed by the space between the electrodes 2 and 3 with the enlarged spacing D. Particularly, the discharge zone is between the inserts 8 and 9. The diameter of the bore holes 5 and 6 is preferably chosen to be smaller than the spacing D of the electrodes 2 and 3 in the discharge zone 11. This spacing D ranges from about 2 to 8 mm, and in certain embodiments 4 to 6 mm, with the exemplary embodiment having a spacing D of about 5 mm. The spacing D is chosen to be substantially larger than the spacing $d_1$ between the electrodes in an insulating zone 13 in the axial direction of the electrodes 2, 3. This insulating zone 13 is located at the inner rim of a washer-shaped insulator 16.

The spacing D of the discharge zone 11 is also larger than the spacing $d_2$ in a shielding zone 12 located between the discharge zone 11 and the insulator 16. The edges of the electrodes 2 and 3 are fastened to the insulator 16 in a gastight manner. The spacing $d_1$ is at least as large as the spacing $d_2$ and can be, for example, between 0.5 to 6 mm, and in certain embodiments between 2 to 4 mm with the exemplary embodiment having a spacing $d_1$ of about 3 mm. The washer-like insulator 16 has a thickness A, and is extended by a socket 23 of electrically insulating material to extend the insulating paths between the outer ends of electrodes 2 and 3.

Above the discharge path 10 is a control device 25 with a housing 26 that encloses a cathode backspace 24. A hollow cylindrical extension of the housing 26 forms a preionization hollow cathode 28 that surrounds a hollow cathode region 32. The preionization hollow cathode 28 protrudes into an anode region 31 of a preionization space 30. The housing 26 is provided with openings 27 and is separated from the hollow cathode region 32 by a gas-permeable metallic partition 29. The partition 29 is provided with openings and is a fine-mesh grid or a net, for example, The preionization space 30 is surrounded by a cup-shaped control electrode (a "keep-alive electrode") 33 which rests on a ring-shaped insulator 34. The insulator 34 is coupled to the electrode 2 in a gastight manner.

At least one of the electrodes 2 and 3, for instance, the cathode 2, is provided between the discharge zone 11 and the insulator 16 with at least one shield 18. The other electrode, for example the anode 3, has a corresponding recess 21 into which the shield 18 protrudes in such a manner that the shielding zone 12 between the discharge zone 11 and the insulator 16 has a U-ring-shaped form. By this construction, diffusion from the discharge path 10 to the insulator 16 as well as irradiation of the insulator by ultraviolet and X-ray photons from the discharge zone 11 is practically impossible.

The discharge switch is filled with ionizable gas so that the firing voltage of the gas discharge switch decreases if the product of the electrode spacing D at the discharge path 10 and the gas pressure p increases. A fast, spark-like gas discharge at the discharge path 10 is initiated by either a predischarge in the preionization space 30 by the control electrode 33 or if the breakdown voltage is exceeded. For example, with a spacing D of the discharge path of about 4 mm, a spacing $d_1$ in the insulating zone 13 and $d_2$ in the shielding zone 12 of about 2 mm each, a gas filling of helium at a pressure $p=60$ Pa to yield a product $p \times d=240$ Pa mm, a dielectric strength of the discharge path 10 of at least 20 kV is obtained In a contemplated embodiment of the gas discharge switch, a magnetic field is provided that permeates the preionization space 30 and is aligned approximately parallel to the axis of rotation 4. With this magnetic field, the operating voltage can be reduced and thereby, the pressure range accessible for the triggering can be increased.

Figure 2:
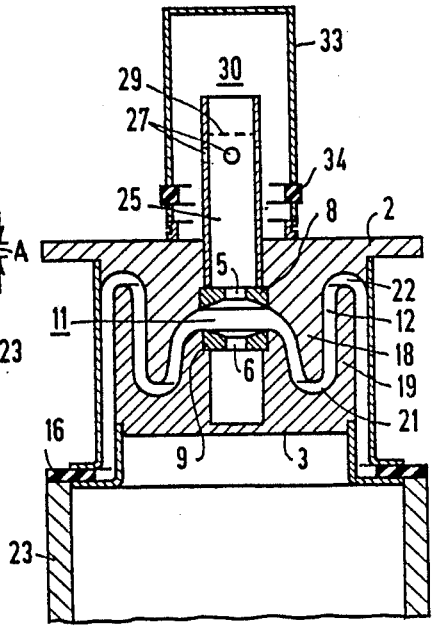
FIG. 2 shows a cross-section of another embodiment of a gas discharge switch according to the present invention.

In the embodiment of the gas discharge switch illustrated in FIG. 2, the mutually opposite surfaces of the electrodes 2 and 3 or the inserts 8 and 9 at the discharge path 10 are provided with recesses. These recesses are not specifically designated in FIG. 2. The recesses increase the spacing of the electrodes in the discharge region 11. In this embodiment, the electrodes 2 and 3 are provided between the discharge region 11 and the insulator 16 with shields 18 and 19, respectively. The electrodes 2 and 3 also have corresponding recesses 22 and 21, respectively, into which the shields 18 and 19 of the opposite electrode protrude In this embodiment, two U-ring-shaped diffusion barriers are generated in the shielding region 12 between the discharge region 11 and the insulator 16. These diffusion barriers prevent diffusion of the metal vapor from the discharge region 11 to the insulator 16.

Figure 3:
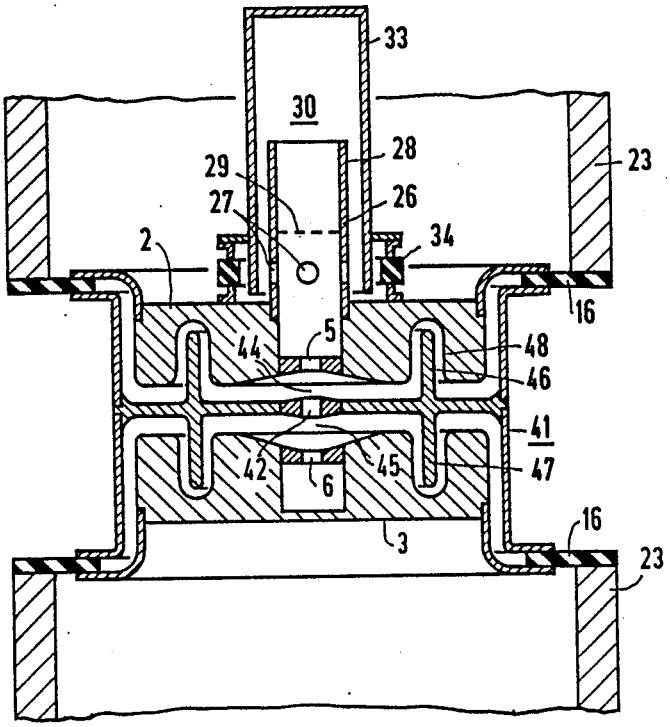
FIG. 3 shows a cross-section of a gas discharge switch according to the present invention that is usable for higher voltages.

In the embodiment of the gas discharge switch shown in FIG. 3, a series connection of discharge paths is provided which makes a correspondingly higher switching voltage possible. An intermediate electrode 41 is provided between the electrodes 2 and 3, this intermediate electrode 41 having a coaxial bore hole 42 that forms with the holes 5 and 6 a series connection of discharge paths 44 and 45. The intermediate electrode 41 is provided with two ring-shaped shields 46 and 47 which each protrude into a corresponding recess 48 and 49, of the other two electrodes 2, 3. These shields 46 and 47 likewise serve as diffusion barriers for a metal deposit. With the embodiment of FIG. 3, a corresponding increase of the switching voltage is obtained. Still further intermediate electrodes are provided for higher voltages in contemplated embodiments.

Figure 4:
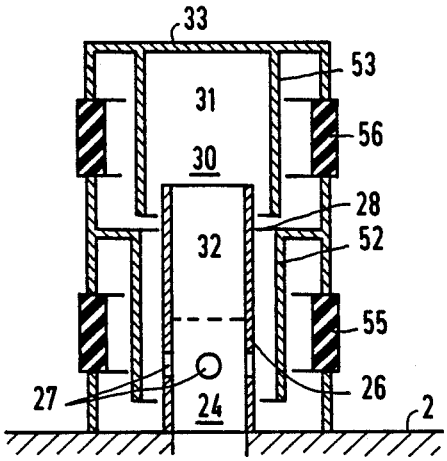
FIGS. 4 and 5 illustrate separate embodiments constructed in accordance with the present invention of the cathode backspace with the preionization space.

In FIG. 4, a different embodiment of the control device 25 with the preionization space 30 is illustrated. In this embodiment, an auxiliary electrode is provided which serves as a blocking electrode 52 and is arranged between two ring-shaped insulators 55 and 56. This blocking electrode 52 has substantially the form of a hollow cylinder with its lower end shielding the openings 27 in the housing 26. To this blocking electrode 52, a positive potential is preferably applied prior to the switching operation. The positive potential extends through the openings 27 into the housing 26 and prevents premature triggering of the switching operation. Diffusion of metal vapor to the insulator 55 is therefore not possible. For the second insulator 56, there is an extension 53 of the preionization electrode 33 which shields the insulator 56.

Figure 5:
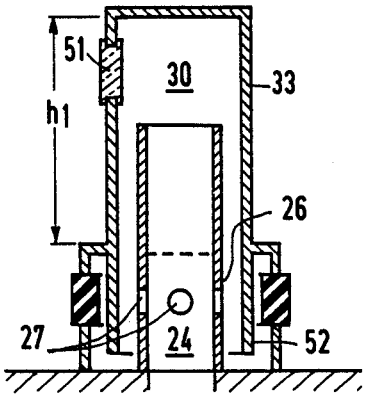

In the embodiment of the control device of FIG. 5, the blocking electrode 52 is integrated into the control electrode 33. For this purpose, the control electrode 33 is extended so far that its lower end covers up the openings 27 of the housing 26 of the cathode backspace 24. The potential of the blocking electrode 52 relative to the cathode potential is therefore equal to the operating voltage of the preionization discharge in the preionization space 30 and can be adjusted to the required magnitude by its height $h_1$. The height $h_1$ will therefore generally be at least several centimeters.

In the illustrated embodiment of FIG. 5, the housing of the control electrode 33 is provided with a window 51 for coupling microwaves. This window 51 can consist of plastic or quartz, for example.

Figure 6:
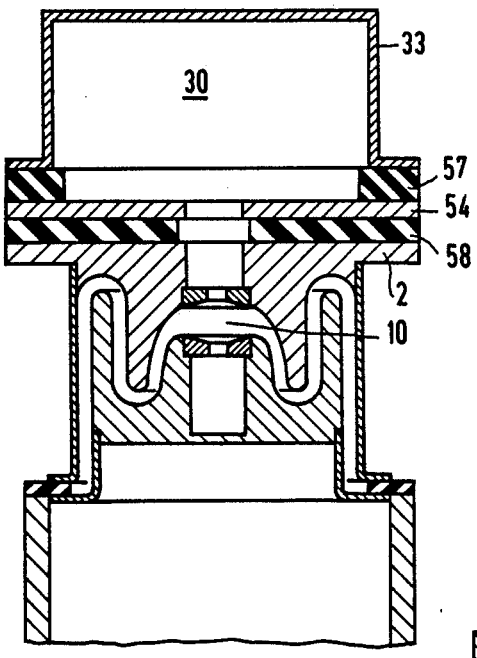
FIG. 6 shows an embodiment of a separate preionization electrode.

In the embodiment of the gas discharge switch according to FIG. 6, the cup-shaped control electrode 33 is separated from the cathode 2 by a decoupling electrode 54. This decoupling electrode 54 is separated from the control electrode 33 and the electrode 2 by respective electric insulators 57 and 58. In this embodiment of the gas discharge switch without a preionization hollow cathode, the decoupling electrode 54 serves for decoupling the preionization in the preionization space 30 from the discharge path 10.

Figure 7:
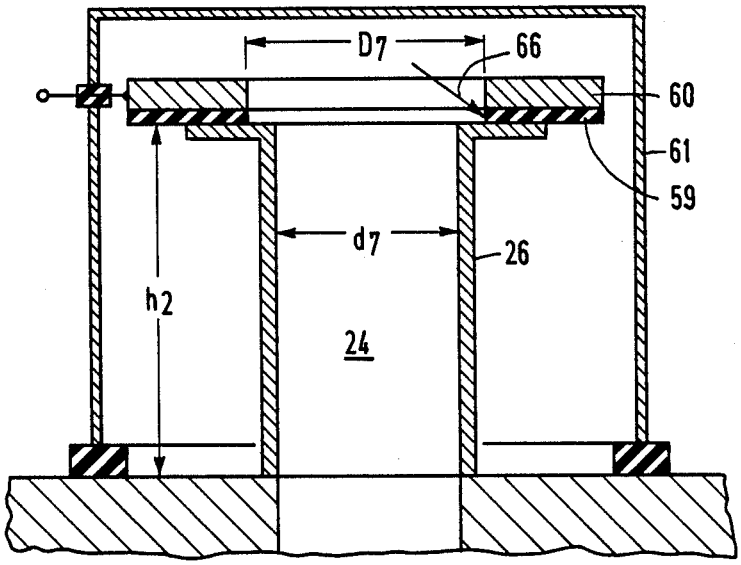
FIG. 7, illustrates an embodiment of a preionization electrode that controls the gas discharge by a sliding discharge.

In the embodiment of the gas discharge switch shown in FIG. 7, there is control by a sliding discharge. A trigger electrode 60 in the form of a ring is provided which is separated by a thin intermediate layer 59 from the housing 26 of the cathode backspace 24. The intermediate layer 59 is shown in the figure with somewhat heavier lines, and is made of a material with higher electric resistivity than metal, such as organic insulators, mylar, semiconductors, and graphite. The thickness of the intermediate layer 59 should be about 0.1 to 0.2 mm and generally not substantially exceed 0.5 mm.

The control device for sliding discharge has a housing 61 which can consist of metal, for example. By applying a control voltage pulse between the trigger electrode 60 and the cathode 26, a sliding discharge is forced over the surface of the thin intermediate layer 59 after previous conditioning with higher voltages if necessary. By this sliding discharge, charge carriers and plasma are injected into the cathode backspace 24 and trigger the switching operation at the discharge path 10.

The inside diameter $D_7$ of the intermediate layer 59, over the surface of which the sliding discharge is fired, is larger than the inside diameter $d_7$ of the housing 26 of the cathode backspace 24. Thereby, the exposed surface of the intermediate layer 59, indicated by an arrow 66, is shielded by the upper edge of the inside surface of the housing 26 against a discharge at the discharge path 10.

The distance between the location 66 of the sliding discharge at the surface of the intermediate layer 59, from the discharge path 10 is essentially determined by the height $h_2$ of the cathode backspace 24. This height $h_2$ is as large as possible for limiting the erosion of the sliding discharge path and therefore, for increasing the life of the gas discharge switch. In certain embodiments of the gas discharge switch, the height $h_2$ is at least twice that of the inside diameter $d_7$ of the housing 26.

Figure 8:
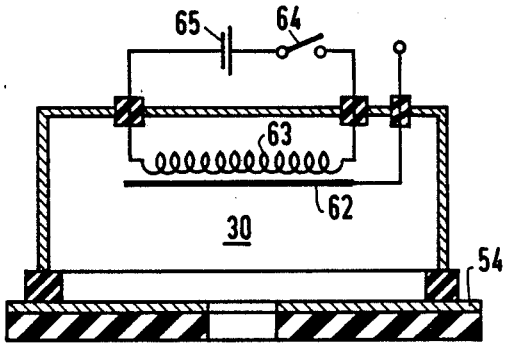
FIG. 8 shows an embodiment according to the present invention of a separate electron source for the gas discharge switch.

In the embodiment according to FIG. 8, an incandescent cathode 62 is provided in the preionization space 30 with which a heating device, for instance, a heating coil 63 is associated. The heating coil 63 can be connected to a heating current source 65 via a suitable switch 64. In this embodiment with an indirectly or optionally a directly heated incandescent cathode 62, the electron current is controlled by means of the decoupling electrode 54.

Figure 9:
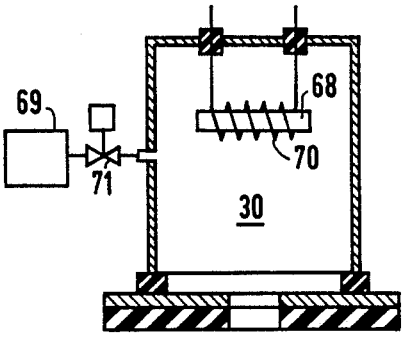
FIG. 9 shows two embodiment of gas storage devices for the gas discharge switch.

The gas discharge switch according to FIG. 9 is provided with an internal hydrogen reservoir which has a metallic gas accumulator 68 for hydrogen or deuterium. This gas accumulator 68 can consist, for instance, of palladium, titanium or tantalum, in the lattice of which hydrogen is stored. The gas accumulator 68 is likewise equipped with a heating device which, in the illustrated embodiment, is a heating coil 70 that is connected to a heating current source, not shown in the figure. In conjunction with the invention, the gas reservoir of the gas accumulator 68 can serve as a pressure control system for the gas discharge switch. In this embodiment, the operating voltage of the preionization discharge or its pressure can be measured and the addition of gas can be controlled as a function thereof. For the addition of gas, an electrically controlled gas dosing valve 71 or a diaphragm valve which controls the gas supply from an external gas accumulator 69 if the pressure drops or the operating voltage rises, until the pressure or the operating voltage again reach their normal operating value.

What is claimed is:

1. A gas discharge switch, comprising:

at least two coaxial electrodes having coaxial holes, with space between said coaxial electrodes forming a central discharge region for a gas discharge path, an insulating region at edges of said coaxial electrodes and a shielding region between the discharge region and the insulating region, a control device coupled to the coaxial electrodes and having a cathode backspace, said control device firing a gas discharge by injecting charge carriers in said cathode backspace;

a washer-shaped insulator having flat sides and an inner edge, and respectively coupled on each side with one of said coaxial electrodes in said insulating region; and means for shielding the insulator arranged in said shielding region;

wherein spacing D of said coaxial electrodes in said discharge region is larger than spacing $d_1$ of said coaxial electrodes in said insulating region at the inner edge of said insulator, with said spacing $d_1$ in said insulating region being at least as large as spacing $d_2$ of said coaxial electrodes in said shielding region.

2. The gas discharge switch according to claim 1, wherein the spacing $d_2$ of the electrodes in the shielding region is equal to or less than one-half of the spacing D of the electrodes in the discharge region.

3. The gas discharge switch according to claim 1, wherein the spacing $d_1$ of the electrodes in the insulating region is approximately equal to the thickness of the insulator.

4. The gas discharge switch according to claim 1, wherein said shielding region has at least one U-ring-shaped structure.

5. The gas discharge switch according to claim 1, wherein said gas discharge path comprises a series circuit of discharge paths.

6. The gas discharge switch according to claim 1, further comprising means for creating a glow discharge to control the gas discharge.

7. The gas discharge switch according to claim 6, wherein said means for creating a glow discharge is a hollow cylindrical housing forming a cathode backspace and includes a hollow cylindrical preionization cathode which surrounds a cathode region, the preionization cathode having an open end that is opposite an anode region of a preionization space.

8. The gas discharge switch according to claim 7, wherein said housing has an outer surface with openings, said gas discharge switch further comprising a blocking electrode associated with said openings.

9. The gas discharge switch according to claim 7, further comprising means for providing a magnetic field around the preionization space.

10. The gas discharge switch according to claim 8, wherein the means for creating a glow discharge includes a control electrode, with said blocking electrode being electrically insulated from said control electrode and said coaxial electrodes

11. The gas discharge switch according to claim 8, wherein the means for creating a glow discharge includes a control electrode, with said blocking electrode being integrated in the control electrode.

12. The gas discharge switch according to claim 11, wherein the control electrode includes a window allowing for coupling of microwaves.

13. The gas discharge switch according to claim 6, wherein the means for creating a glow discharge further comprises a decoupling electrode associated with the control electrode.

14. The gas discharge switch according to claim 1, wherein at least one component of the working gas consists of mercury Hg.

15. The gas discharge switch according to claim 1, further comprising means for controlling the gas discharge by a sliding discharge.

16. The gas discharge switch according to claim 1, further comprising an incandescent cathode that is an electron source.

17. The gas discharge switch according to claim 1, further comprising means for controlling a supply of working gas as a function of at least one of the operating voltage of a preionization discharge and the pressure of the working gas.

18. The gas discharge switch according to claim 17, further comprising a gas reservoir which controls the gas pressure.

* * * * *